US005375730A

United States Patent [19]

Bahr et al.

[11] Patent Number: 5,375,730

[45] Date of Patent: Dec. 27, 1994

[54] UNLOADING VALVE FOR HOPPER CAR

[75] Inventors: Andrew J. Bahr, Cayuga; Luigi P. Simonelli, Mt. Hope, both of Canada; Wallace G. Murray, Monroe, La.

[73] Assignee: Columbian Chemicals Company, Atlanta, Ga.

[21] Appl. No.: 23,319

[22] Filed: Feb. 26, 1993

[51] Int. Cl.[5] ..... B65D 45/16

[52] U.S. Cl. ..... 220/324; 220/347; 215/231; 215/284; 138/89; 285/312; 285/901; 406/145

[58] Field of Search ..... 220/233, 262, 324, 347; 215/231, 273, 280, 284, 354, 355; 138/89; 285/24, 27, 312, 901; 406/129, 145

[56] References Cited

U.S. PATENT DOCUMENTS

| | | | |
|---|---|---|---|
| 3,020,092 | 2/1962 | Dorey | 406/145 |
| 3,079,032 | 2/1963 | Dorey . | |
| 3,177,042 | 4/1965 | Borger et al. | 406/145 |
| 3,195,961 | 7/1965 | Borger . | |
| 3,439,942 | 4/1969 | Moore et al. | 285/312 X |
| 3,572,844 | 3/1971 | Mundinger . | |
| 3,672,403 | 6/1972 | Wilson et al. | 138/89 |
| 3,700,143 | 10/1972 | Shaver . | |
| 4,802,694 | 2/1989 | Vargo | 285/901 X |
| 4,975,000 | 12/1990 | Fritz . | |
| 5,000,358 | 3/1991 | Dugge . | |
| 5,078,291 | 1/1992 | Gilmour | 220/324 X |

*Primary Examiner*—Gary E. Elkins
*Assistant Examiner*—Stephen Cronin
*Attorney, Agent, or Firm*—Pravel, Hewitt, Kimball & Krieger

[57] ABSTRACT

An unloading valve for hopper cars used for transporting dry fluent material such as carbon black. An unloading pipe extends outwardly from the bottom of the hopper, and a closure removably attaches at the end of the pipe. The closure includes a plug extending within the pipe and presenting a surface that confronts the dry fluent material adjacent the inner end of the pipe. This surface has an angle selected to cause fluent material loaded into the hopper to become packed at the inner end of the pipe during loading and subsequent shipment of the hopper car. When the closure is removed for attaching an unloading conduit to the pipe, the packed material at the inner end of the pipe prevents any of that material from leaking out the pipe before the unloading conduit can be connected.

15 Claims, 2 Drawing Sheets

UNLOADING VALVE FOR HOPPER CAR

FIELD OF THE INVENTION

This invention relates in general to materials handling, and relates in particular to handling of dry fluent or powdery materials.

BACKGROUND OF THE INVENTION

Commodity products for applications requiring a relatively large volume of the product frequently are shipped in bulk to the point of use. Where the product is a dry fluent material such as a granular or powdery product, bulk shipments may be in hopper cars, where the material is withdrawn from an outlet at the bottom of the hopper. The construction and utilization of such hopper cars is well known to those skilled in the art.

Where relatively coarse or granular materials are delivered by hopper car, those materials can be dumped from the hopper by opening one or more gate valves fitted at the bottom of each hopper. That technique of unloading a hopper car is not feasible with relatively fine or powdery materials such as carbon black. The relatively fine particle size of such materials causes particles to become airborne if the material simply is dumped through a gate valve or another kind of open flow channel. As a result, hopper cars used for transporting carbon black or other relatively fine or powdery materials usually are fitted with a pipe connection at the bottom of the hopper, either in place of the gate valve or as an add-on thereto, for connecting a hose or pipe that transfers the commodity. Reduced air pressure is applied to that hose or pipe, thereby creating an air flow to withdraw the relatively fine or powdery commodity from the bottom of the hopper car.

Once a hose or pipe is connected to the hopper car as described above to withdraw the contents of the hopper, a relatively closed system exists which prevents spilling or airborne dispersion of relatively fine particles during unloading. However, the opportunity remains for unwanted spilling or dumping of the fine material while connecting the delivery hose to the hopper car. Where a hopper car is equipped with a pipe and associated fittings for directly connecting the delivery hose, a cap or other closure must be removed from the pipe before the hose can be connected to that pipe. Given the pressure head that may be present when uncapping a delivery pipe at the bottom of a fully-loaded hopper car, a considerable amount of powdery commodity can pour from the uncovered pipe during the brief time needed to attach a receiving hose. This wasted commodity tends to accumulate at a particular location as a succession of hopper cars are unloaded at that location, creating a messy and potentially hazardous work environment. Spillage during the unloading of a powdery commodity is exacerbated where workers must attach a receiving-hose adapter to the conventional gate valve fitting at the bottom of the hopper car, which can be accomplished only while lying on one's back beneath the car.

SUMMARY OF INVENTION

Stated in general terms, the present invention prevents a fine or powdery material such as carbon black from entering the discharge pipe on a hopper car while the car is being filled during shipment of the material. Furthermore, the present invention causes the powdery carbon black to become packed at the entrance to the discharge pipe in a manner that prevents the material from immediately pouring forth when the discharge pipe is uncapped. Thus, the cap can be removed from the discharge pipe without unwanted discharge of the commodity from the open pipe during the time required to attach a delivery hose.

Stated in somewhat greater detail, the present invention includes a member having a surface confronting the dry fluent material at or near a point remote from the outer end of the discharge pipe. This surface preferably confronts the fluent material in the delivery pipe at an acute angle that causes the fluent material to become packed at or near the opening from the hopper to the discharge pipe, as the fluent material settles within the hopper car during shipment. This packing of the fluent material prevents that material from immediately flowing out the discharge pipe when that pipe is uncapped, so that the delivery hose can be attached to the pipe without loss or wasteage of the fluent material.

Stated with further detail, the confronting surface is disposed at one end of a plug inserted into the discharge pipe while fluent material is being loaded into the hopper car, and during shipment of that car. This plug preferably is attached to a closure which removably attaches to a free end of the discharge pipe, so that the plug with its angled confronting surface becomes removed from the discharge pipe when the closure itself is removed.

Accordingly, it is an object of the present invention to provide an improved unloading apparatus for hopper cars transporting dry fluent material, particularly of a fine or powdery nature.

It is another object of the present invention to provide a hopper car unloading valve that prevents unwanted flow of dry fluent material from the car when a discharge pipe is uncapped to connect a delivery conduit.

It is a further object of the present invention to provide a hopper car unloading valve that permits attachment of a delivery conduit without spilling any contents of the hopper car.

Other objects and advantages of the present invention will become more readily apparent from the following discussion of a preferred embodiment.

DETAILED DESCRIPTION OF PREFERRED EMBODIMENT

Figure 1:
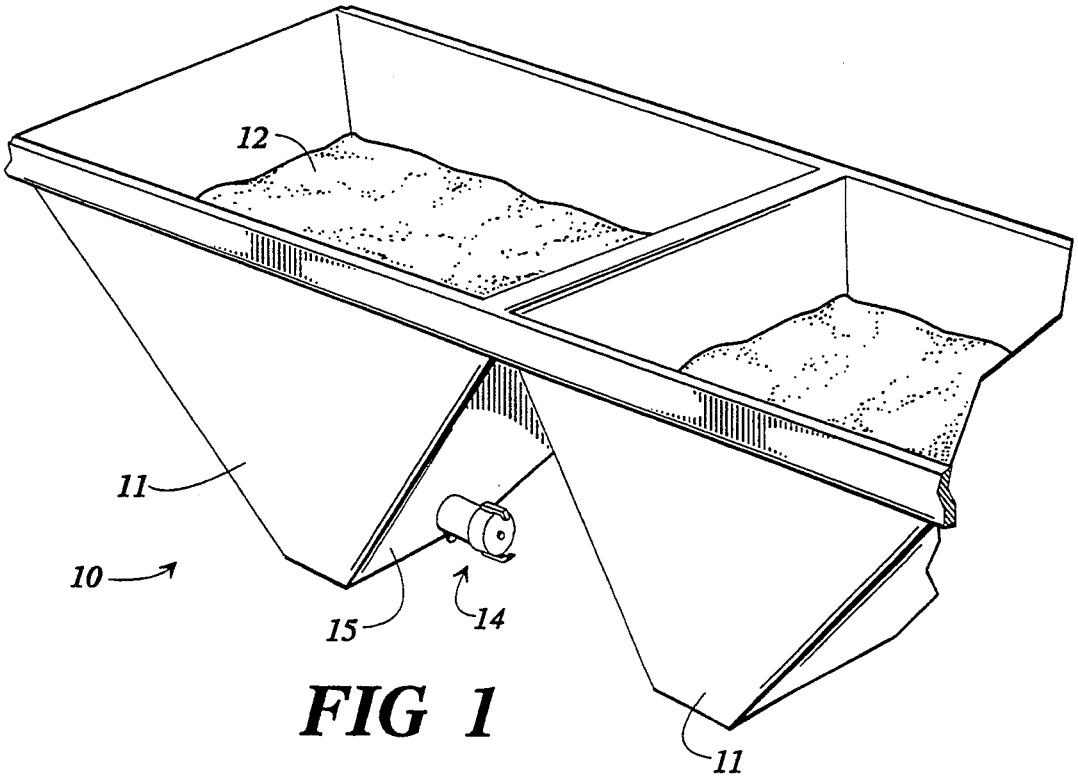
FIG. 1 is a fragmentary pictorial view of a hopper car equipped with a preferred embodiment of the present invention.

Turning first to FIG. 1, there is shown generally at 10 the hopper portion of a rail car having a pair of individual hoppers 11 each filled with a material 12, which in the example of the preferred embodiment is carbon black. Those skilled in the art will realize that the conventional rail hopper car also includes frame structure, trucks and related running gear, and other apparatus forming no part of the present invention and thus not shown or described further herein. Each of the hoppers 11 has a separate unloading pipe, one of which is shown at 14, mounted at or near the bottom of one of the inclined walls 15 comprising the hopper. These walls 15 extend transversely across the width of the conventional hopper car, and each unloading pipe 14 thus extends parallel to the longitudinal axis of the hopper car. This placement of the unloading pipe 14 does not interfere with the overall width profile of the standard hopper car.

Figure 2:
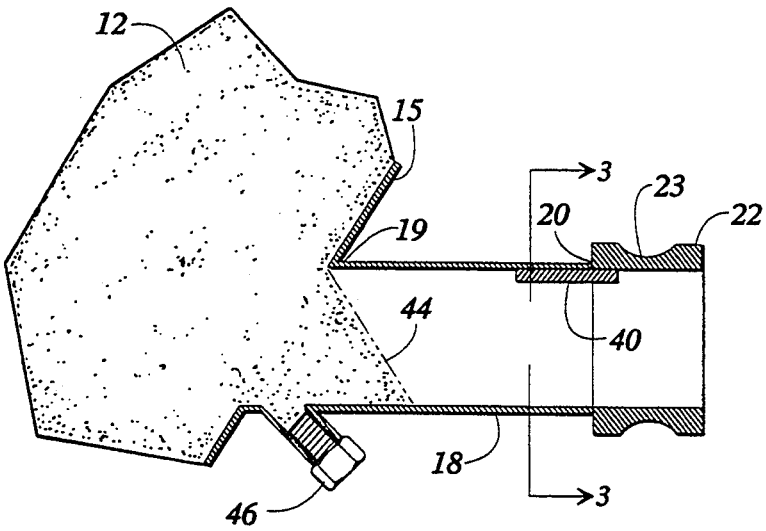
FIG. 2 is an enlarged partial cross-section view of the apparatus shown in FIG. 1, without: the closure present in that Figure.
Figure 3:
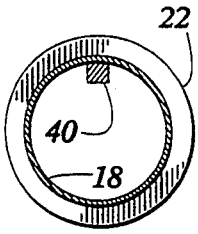
FIG. 3 is a section view taken along line 3—3 of FIG. 2.
Figure 4:
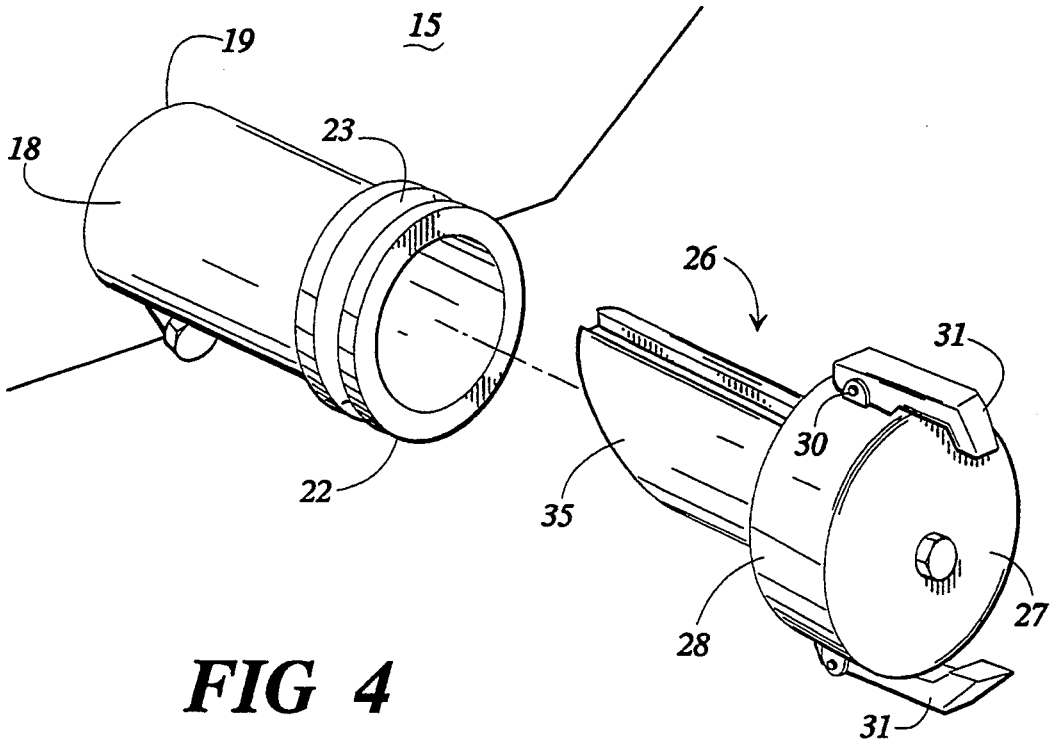
FIG. 4 is an exploded pictorial view showing the closure removed from the delivery pipe of the disclosed embodiment.

Turning next to FIGS. 2–4, each unloading pipe 14 comprises a length of pipe 18 having an inner end 19 attached by welding to the hopper wall 15 and communicating with an opening in the hopper wall. The outer end 20 of the pipe 18 is located a short distance outwardly from the hopper wall 15. This outer end 20 terminates at a collar 22 having an inner diameter matching that of the pipe 18. The thickness of the collar 19 is somewhat greater than that of the pipe 18, and an annular channel 23 is formed in the outer circumference of the collar. The inner diameter of the pipe 18 and the collar 22 is four inches in an actual embodiment of the present invention fitted on rail hopper cars used for transporting carbon black, although it should be understood that the inner dimension of the pipe and collar are not considered limitations of the present invention.

A separate closure 26 removably attaches to the outer end 20 of the pipe 18 to block the flow of material 12 in the hopper from flowing through that pipe. The closure 26 includes a cap 27 having an annular skirt 28 to fit around the collar 22 on the outer end of the pipe 18. A pair of locking cams 29 extend inwardly through openings in the skirt 28, for selective engagement with the annular channel 23 on the collar 22. Each locking cam 29 is pivotably mounted at 30 on the skirt 28, as shown in FIG. 4, and a handle 31 extends outwardly from the pivot point for manipulating the locking cam.

Figure 5:
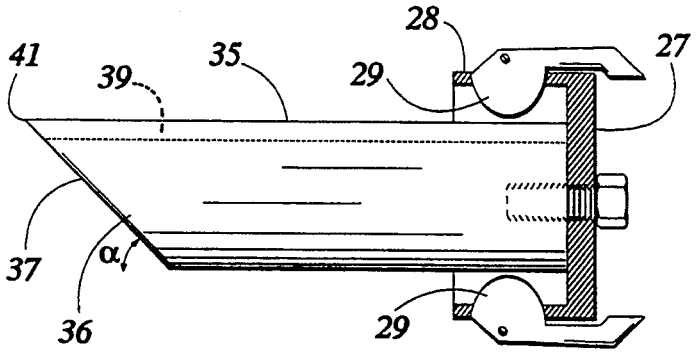
FIG. 5 is a side elevation view of the closure shown in FIG. 4.
Figure 6:
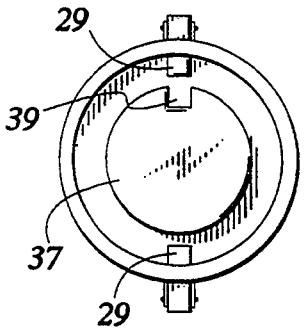
FIG. 6 is an end elevation view taken from the left of FIG. 5.

The closure 26 also includes a plug 35 bolted to the end of the cap 27 and extending axially outwardly beyond the end of the skirt 28. The plug 35 terminates at a remote end 36 having a surface 37 at an acute angle $\alpha$ extending upwardly from the bottom of the plug. The plug 35 in a preferred embodiment is made of polyethylene and has a longitudinal keyway 39 machined along the top surface of the plug as seen in FIGS. 5 and 6. This keyway mates with the key 40, FIGS. 2 and 3, welded inside the outer end 20 of the pipe 18. The closure 26 preferably is connected to the hopper 11 by means of a safety chain (not shown) so that the closure at all times remains with the hopper car.

The operation of the present unloading valve is now considered with regard to the foregoing description. Before the material 12 is loaded into the hopper 11, the closure 26 is installed at the outer end 20 of the pipe 18 such that the cap 27 surrounds the collar 22 at that end of the pipe. The key 40 within the upper end of the pipe 18 engages the keyway 39 in the plug 35, ensuring that the plug enters the pipe in the attitude shown in FIGS. 4 and 5, that is, with the longest portion 41 of the plug 18 at the top of the pipe. The length of the plug 35 is chosen so that the longest portion 41 is substantially coterminous with the inner end 19 of the pipe 18 when the closure 26 is attached to the pipe. With the closure 26 thus attached, the cams 29 are lowered to engage the annular channel 23 around the exterior of the collar 22.

The hopper 11 now is ready to receive a bulk quantity of the material 12. That material settles within the hopper 11 during loading as the material is loaded into the top of the hopper, and further settlement and compaction of the material takes place while the hopper car travels to its destination. This settlement and packing causes the material 12 to become densely packed at the region 44, FIG. 2, near the inner end 19 of the pipe 18, immediately confronting the diagonal surface 37 of the plug 35 (not shown in FIG. 2). Furthermore, the plug 35 prevents the material 12 from entering the pipe 18 beyond the diagonal surface 37 during filling and shipment. As a result of this packing, the material remains compacted substantially along the sloped region 34 at the inner end of the pipe 18 when the closure 26 is removed from the pipe 18, so that an unloading hose (not shown) can be attached to the collar 22 with no leakage of material from the open pipe 18.

The diagonal surface 37 at the free end of the plug 35 preferably is cut on an angle $\alpha$, approximating or exceeding the natural angle of repose for the material 12 being shipped in the hopper car. Those skilled in the art will understand that this angle will vary for different materials, depending on such factors as particle size, surface roughness of the individual particles, and the compressability of those particles. An angle $\alpha$ of 45° is used on an actual embodiment of the present invention used with hopper cars shipping carbon black products, although that particular angle is not considered critical to the present invention.

With some kinds of materials, the material packing that takes place immediately behind tile diagonal surface 37 of the plug 35 may prevent any material from flowing through the pipe 18 when an unloading hose is connected. To overcome that possible problem, a blowout plug 46 (FIG. 2) may be provided on the bottom near the inner end of the pipe 18. If a blockage of material 12 remains at the inner end 19 of the pipe 18 after the unloading hose is connected, the blowout plug 46 is removed and replaced by an air hose which injects a jet of compressed air to break up the blockage.

It should be understood that the foregoing refers only to a preferred embodiment of the present invention and that numerous changes and modifications therein may be made without departing from the spirit and scope of the invention as defined in the following claims.

What is claimed is:

1. An apparatus controlling the flow of dry fluent material from a compartment containing a supply of such material, comprising:

means defining an open ended bore in communication with the compartment for withdrawal of the fluent material from the compartment;

plug means removably disposed in the bore defining a closed position that prevents unwanted material flow therethrough; and the plug means having an inclined surface at least partially confronting the fluent material within the bore at an angle operative to cause the fluent material to become packed in the bore when the fluent material is loaded into the container, the plug means being oriented so that an upper portion of the inclined surface is closer than a lower portion of the inclined surface to the central portion of the compartment;

so that the packed fluent material in the bore inhibits the fluent material from leaking from the bore when the plug means is removed form the bore preparatory to withdrawing the fluent material from the container.

2. Apparatus as in claim 1, wherein:

the opening further comprises a tubular member attached thereto in flow communication with the container.

3. Apparatus as in claim 2, wherein the surface of the plug means in the tubular member at least partially confronts the fluent material within the tubular member.

4. Apparatus as in claim 2, wherein:

the plug means comprises an elongate member which removably fits into the tubular member to block material flow therethrough; and the surface comprises the end of the elongate member extending into blocking contact with the fluent material.

5. Apparatus as in claim 4, further comprising:

a cap selectively attached to an outer end of the tubular member to close that outer end; and the elongate member extends from the cap to fit within the tubular member.

6. In a hopper for containing a dry fluent material, an unloading valve comprising:

a pipe having a bore for communicating with the hopper and having a first end extending outside the hopper and a second end communicating with the hopper;

a closure removably attached to the pipe at the bore defining a closed position that blocks the flow of material through the pipe bore from the hopper; and the closure having an inclined surface which extends within the pipe bore when the closure is attached to the pipe at the bore and confronts the fluent material within the pipe bore at an angle operative to cause the fluent material to become packed within the pipe bore when confronting the angled surface, the closure being oriented in the closed position so that an upper portion of the inclined surface is closer than a lower portion of the inclined surface to the central portion of the hopper;

so that the packed fluent material within the pipe bore inhibits the material from leaking out the pipe when the closure is removed in preparation for coupling a material withdrawal conduit to the pipe.

7. Apparatus as in claim 6, wherein the pipe is substantially horizontal; and the surface of the closure confronts the fluent material at an acute angle to horizontal.

8. Apparatus as in claim 6, wherein:

the closure comprises an elongate plug that extends into the pipe with the closure attached to the pipe and presents the surface in blocking contact with fluent material entering the pipe from the hopper.

9. Apparatus as in claim 8, wherein the surface comprises an end of the elongate plug.

10. Apparatus as in claim 6, wherein the closure comprises:

a cap operative to fit onto and releasably engage the first end of the pipe;

a plug associated with the cap to extend into the pipe with the cap engaging the first end, the plug substantially occupying the inner dimension of the pipe so as to prevent the flow of fluent material through the pipe; and the plug having an end remote from the cap at an acute angle to the pipe to define the closure surface confronting fluent material entering the pipe from within the hopper.

11. Apparatus as in claim 10, further comprising:

a collar surrounding the first end of the pipe and having an annular channel; and locking means on the cap and operative to engage the annular channel, thereby retaining the closure on the pipe.

12. Apparatus as in claim 10, further comprising:

a selectively operable port communicating with the interior of the pipe near the second end for admitting compressed air to dislodge fluent material that may have clogged the pipe adjacent the second end.

13. Apparatus as in claim 6, wherein the surface confronts the material within the pipe at an acute angle.

14. Apparatus as in claim 13, wherein the angled surface extends upwardly and rearwardly from bottom to top of that surface at the second end of the pipe.

15. Apparatus as in claim 14, further comprising means associated with the pipe to cooperate with the closure so that the angled surface can enter the pipe only with said orientation.

* * * * *